US005541579A

United States Patent [19]

Kiernan

[11] Patent Number: 5,541,579

[45] Date of Patent: Jul. 30, 1996

[54] PERSONAL ALARM SAFETY SYSTEM

[76] Inventor: Christopher Kiernan, 100 Diplomat Dr. Apt. 3D, Mount Kisco, N.Y. 10549

[21] Appl. No.: 408,981

[22] Filed: Mar. 23, 1995

[51] Int. Cl.[6] ..... G08B 21/00

[52] U.S. Cl. ..... 340/573; 200/51.09; 200/61.71; 200/DIG. 2; 340/521; 340/540; 340/693

[58] Field of Search ..... 340/573, 693, 340/521, 540; 200/61.71, DIG. 2, 51.09

[56] References Cited

U.S. PATENT DOCUMENTS

| | | | |
|---|---|---|---|
| 4,884,067 | 11/1989 | Nordholm et al. | 340/573 |
| 4,906,972 | 3/1990 | Spencer | 340/573 |
| 5,157,378 | 10/1992 | Stumberg et al. | 340/521 |

*Primary Examiner*—Glen Swann
*Attorney, Agent, or Firm*—Martin J. Spellman, Jr.

[57] ABSTRACT

A personal alarm safety system warning device will sound an audible alarm when a firefighter is motionless for a predetermined time such as thirty seconds or one minute, and optionally, if the temperature rises beyond a certain level or if the temperature is increasing at a rate above a certain predetermined rate of increase. The alarm system is incorporated in the buckle of the firefighter's air breathing pack harness in such a manner that any time the firefighter buckles the belt for the harness the personal alarm safety system is moved from the Off condition to a armed Standby (On) position ready to set off the alarm when any of the predetermined conditions are met. The device may also be manually activated by the firefighter. In order to turn the device off, not only must the belt buckle be disengaged, a safety switch detent must be manipulated by the firefighter. Thus it is impossible, once the firefighter has donned the harness for the air breathing apparatus, to accidentally completely turn off the personal alarm safety system device except by two intentional distinct and independent movements.

1 Claim, 5 Drawing Sheets

FIG.1
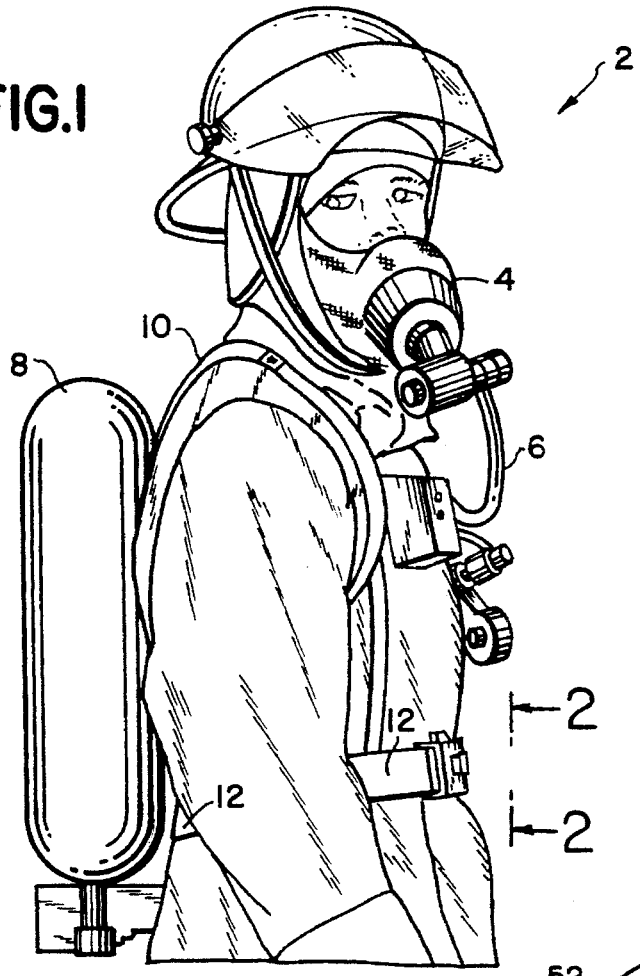
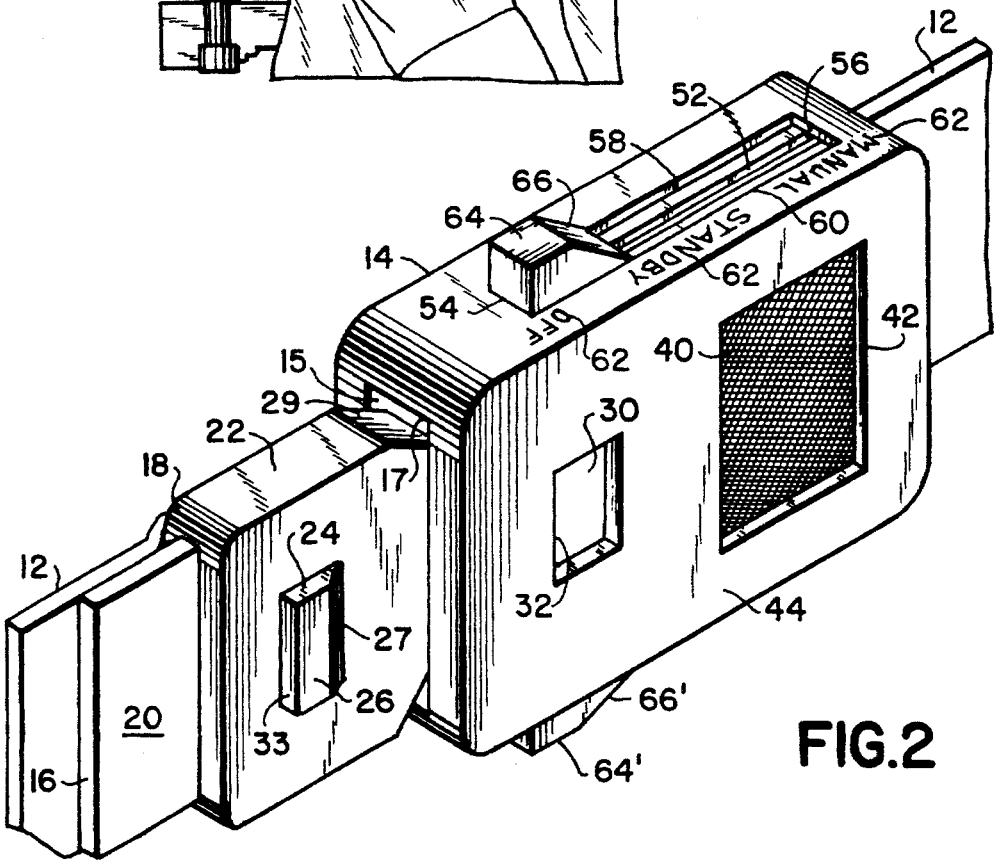
FIG.2

PERSONAL ALARM SAFETY SYSTEM

BACKGROUND OF THE INVENTION

1. Field of the Invention

This invention has to do with personal alarm signal systems (PASS) used by firefighters entering burning buildings that are subject to collapse or being overcome by smoke and any other accidents that can typically befall a fightfigher engaging a fire. Current PASS systems comprise a device that is clipped onto the firefighter's uniform or equipment and manually switched on to a On status. The device will sound an audible alarm or transmit other signals to alert rescuers when there is no motion for say two minutes and/or when the temperature reaches a certain level, or if a temperature gradiant rapidly changes, in all such cases a signal will be sent. This device is battery operated and hence when it is not needed, it should be switched off to conserve the batteries.

As a practical matter, many times firefighters in the rush of donning their equipment, carrying equipment ie. gear, and air bottles will overlook turning the switch on this PASS alarm device. Thus, when they are in a difficult situation the alarm fails to sound, simply because it has not been activated prior to entering a dangerous area.

In 1994, of six firefighters in New York City who died in fires, five had not activated their alarms.

The device of the present invention provides a means of making sure that the firefighter has activated the alarm when entering situations where the alarm should be ready to be utilized when needed.

2. Prior Art

One approach, in an attempt to insure that the alarm device is turned on when the firefighter enters a dangerous situation is to tie the switch into a pressure sensor connected to the air chamber of the SCBA (Self Contained Breathing Apparatus) packs which firefighters use. However, this means that the switch has to be disconnected every time that the person changes air bottles and thus the firefighter will know that it is not turned on because of a lack of air. He can still enter a dangerous situation, not have the air on, and not have the PASS alarm on On and the alarm would not be sounded. Also, such devices are unnecessarily complex and subject to many functional failures.

According to the present invention, this deficiency is overcome by incorporating the Off, On, and Manual switch for the PASS device into the buckling system for the harness for SCBA packs. Thus every time the firefighter dons and straps on the carrying harness for a SCBA air pack, the PASS device is activated, thus eliminating the chance of the oversight of entering a burning building or other dangerous situation and accidentally forgetting to turn on the PASS device.

The patent to STUMBERG et al. U.S. Pat. No. 5,157,378 discloses a personal alert safety system (PASS) much like the above system which uses a pressure switch that is connected to a pressure sensor. It is connected to the air pack and when the pressure flow is detected it activates the PASS device to On status.

Various belt buckles incorporating switch operating warning systems have been fashioned and are disclosed in U.S. Pat. No. 4,272,039 Hollingsworth, No. 4,163,128 Miskowicz, No. 3,868,627 Lawwill, No. 3,840,849 Lohr, and No. 3,237,710 MacDonald, none of which relate to PASS type of devices.

SUMMARY OF THE INVENTION

In accordance with the present invention, there is provided an improved PASS device system which will automatically be activated each time a firefighter puts on and buckles his/her harness for carrying air bottles.

An on and off switch is incorporated into the belt buckle for the air tank harness and is activated from Off to an On automatically each time the harness is buckled together. This is much simpler, less expensive, and more reliable, compared to prior devices, and does not need to be connected to the air system itself to work.

The device is thus armed and stands ready to broadcast alarms under the conditions of no air, no motion for a specified time, or predetermined temperatures or gradients of temperature and/or other sensing systems presently incorporated in PASS devices on the market and known to those skilled in the art. The device cannot be deactivated until the buckle is unfastened. Thus since the waist strap or belt must be secured in order to carry the breathing apparatus, the firefighter entering a dangerous area cannot forget to activate the PASS device and will always be protected.

The device incorporates a three way switch with an Off, Standby (On), and a Manual (panic) position which can be activated by the firefighter himself should the need arise.

The device also has additional features. The slide switch can be moved into the manual position without any restriction, but in order to move back into Standby (On) or into the Off position a locking device has to be depressed in order to ensure that the device is not accidentally shut off when it is needed, and to move to the Off position the belt must be unbuckled also.

It is not necessary to disconnect and reconnect the device when air bottles are changed and put into the harness, thereby raising the level of reliability.

Most importantly, the user is prevented from overcoming the automatic feature and cannot switch to the Off position while wearing the buckled belt.

In accordance with the present invention, the two part belt buckle system for the air pack includes, on one end of the waist band harness, a female buckle structure into which is incorporated the sensing circuitry elements of existing PASS devices that are known according to the prior art. The device includes these components and circuitry and an Off, Standby (On), and Manual switch mechanism to provide an alarm sounding audibly, with or without, radio transmissions over a defined frequency or frequencies. The device will sound the alarm when placed in the Manual position, and in the Standby (On) position when there is no detected movement for a defined period, usually thirty seconds or a minute, or in some devices when there is a defined temperature reached or predetermined gradient increase in the temperature. In order to turn off the device, intentional affirmative safety by-passing steps must be taken.

All the necessary circuitry is known to those skilled in the art and is easily incorporated in the latching portion of the belt. It is activated to Standby (On) when the tang end of the belt buckle is inserted into the receiver section of the buckle structure.

A conventional button belt lock is provided to hold the tang in place when inserted into the buckle section. It may be released by depressing a spring biased button lock on the face of the device.

The end of the tang when inserted into the device moves the switch from an Off position to an automatically armed Standby (On) position, thus of necessity moving the activating switch of the PASS device to the automatic status position each time the harness belt buckle is latched about the firefighter's body.

The invention herein assures that the PASS device will be activated to On each time the firefighter straps on the air tank apparatus carrying belt or harness and it cannot be turned Off except by direct calculated multiple actions on the part of the firefighter.

BRIEF DESCRIPTION OF THE DRAWINGS

In the accompanying drawing which forms a part of this specification,

FIG. 1 is a perspective view of a firefighter with the backpack and harness and including the belt thereof wearing the SCBA pack and harness therefore and breathing mask, and wherein the device of the present invention is incorporated in the buckle for the belt of the SCBA harness;

FIG. 2 is a perspective view of the air pack harness belt and particularly the belt latching mechanism which incorporates the PASS device into the buckle portion, taken from lines 2—2 of FIG. 1;

ILLUSTRATIVE SPECIFIC EMBODIMENT

Figure 3:
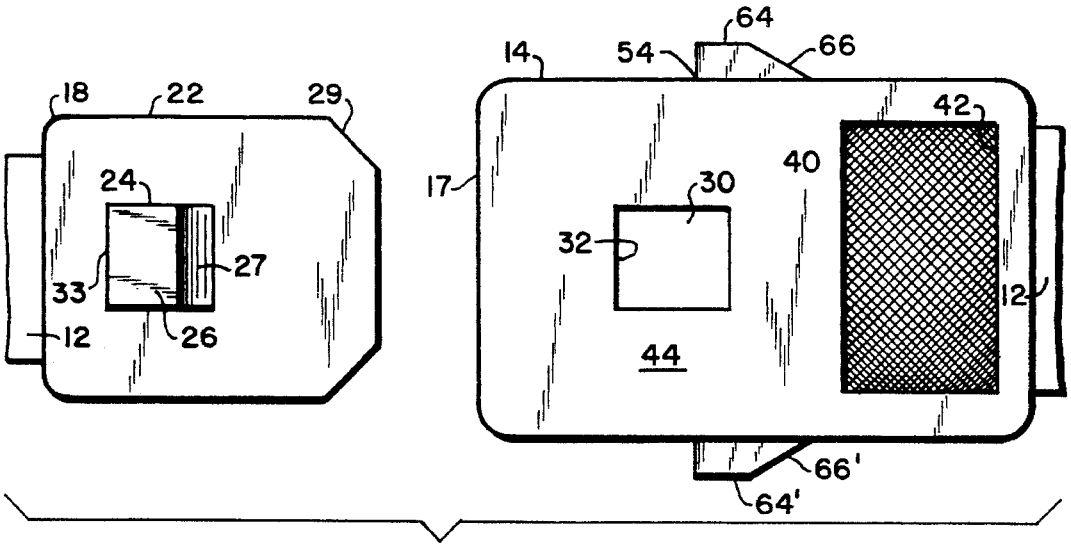
FIG. 3 is a front plain view of the PASS device incorporating the present invention attached to the ends of the waist belt of the SCBA pack harness with the buckle portions shown separately.

Referring to the accompanying drawing which forms a part of this specification, in FIG. 1 a firefighter 2 wearing an air mask 4 which is connected by hose 6 to air tank 8 is shown. The tank 8 is carried by the firefighter 2 utilizing the usual harness 10 which includes waist belt 12. The buckle portion 14 of the belt 12 includes the PASS device incorporated in the buckle 14.

Referring particularly to FIG. 2, the belt 12 on the right side includes end 16 going through receiving means 18 with the adjustable end 20 extending from the tang portion 22 on the right hand side of the belt 12. The tang portion 22 includes a rectangular aperture 24 within which push button 26 is located. The push button 26 has a beveled forward end 27 to cause the push button clasp 26 to depress as it encounters the edges of opening 15 in the side of the female buckle portion 14 and the tang portion 22 enters the opening 15.

Figure 8:
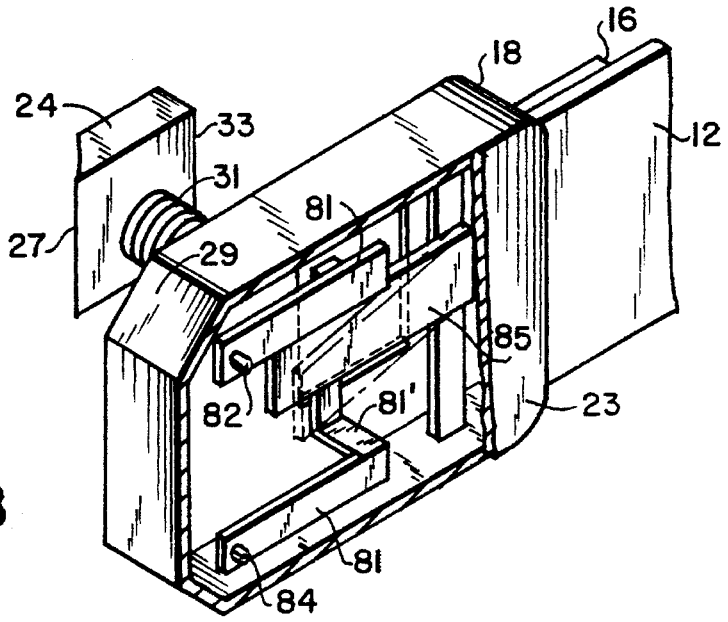
FIG. 8 is a perspective view partially in section taken along lines 8—8 of FIG. 4 of the tang section 22 showing secondary latching means which cooperate with the switch arms in female portion 14.

The push button 26 is spring biased to the outward position by lever spring 31 within the tang housing 22 (FIG. 8). The rear edge 33 of the button 26 will bear against the side edge 32 of the opening 30 in the face 44 of female buckle portion 14 when the tang 22 is inserted into the side opening 15 in the buckle housing 14.

The components of the PASS unit are located in the buckle section 14. A speaker grill 40 is set in opening 42 in the outwardly facing cover 44 of the buckle section 14.

On the frontal surface 44 of the buckle 14 is an aperture 30 through which protrudes the push button 26 of tang portion 22 when the belt is buckled. The push button 26 is spring biased to an extended position. Button 26 when depressed will allow the tang section 22 to be removed from the buckle section 14 by moving the button 26 below the edge 32 of aperture 30 in front 44 of the buckle 14.

A long rectangular opening 52 in the top surface 50 of the buckle 14 is defined by ends 54 and 56 and sides 58 and 60 respectively. Control switch end 64 protrudes upwardly from the opening 52 and switch end 64' protrudes from a similar opening on the lower edge surface respectively. The sides 66 and 66' of the switch ends 64 and 64' are beveled as shown. Indicia 62 showing the Off, Standby (On), and Manual positions of the switch end 64 are provided along the top surface 50 adjacent opening 52.

Figure 5:
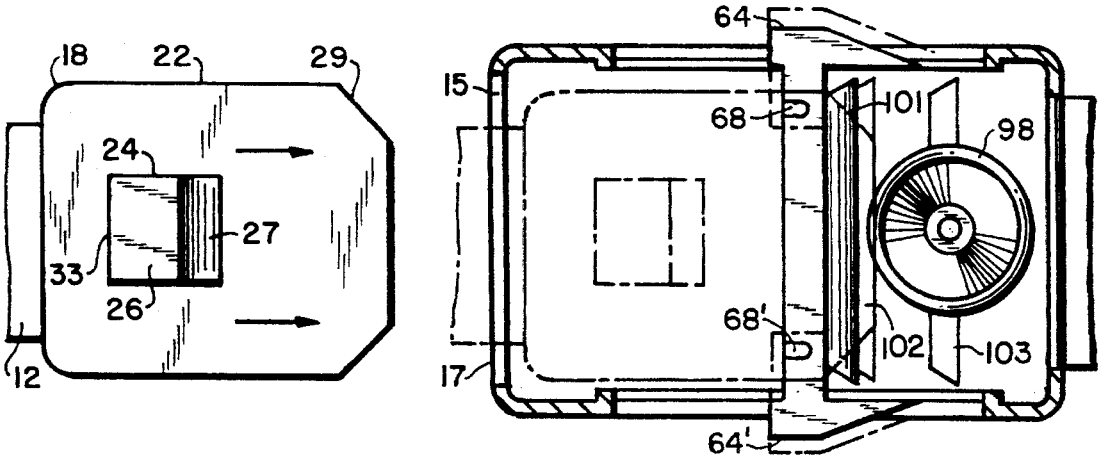
FIG. 5 is a front view, partially in a section taken along line 5—5 of FIG. 4 showing the buckle about to be buckled, and with the right side showing in phantom the position of the tang part when connected together with the female portion and the device is in Standby (On)
Figure 9:
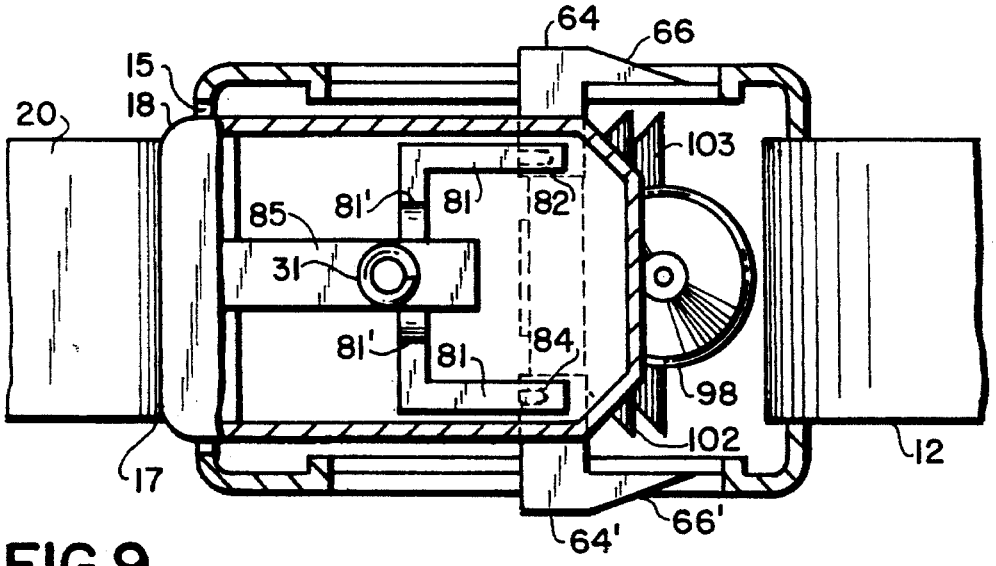
FIG. 9 is a view taken along lines 5.5 and 9—9 of FIG. 4 and showing the device locked together.
Figure 10:
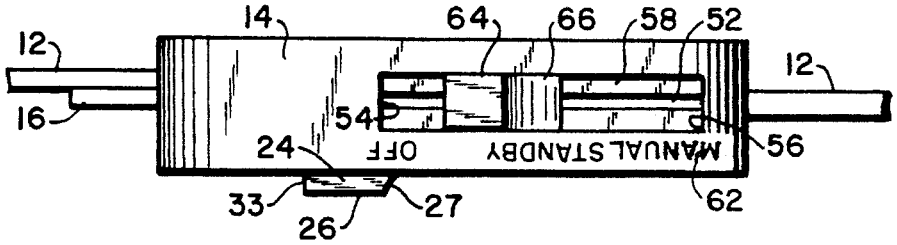
FIG. 10 is a top view of the latched buckle components.

The movable safety switch extensions 64 and 64' include recesses 68 and 68' (FIG. 5) which are engaged by nibs 82 and 84 (FIG. 9) on the arms 81 in the tang 22 to prevent switch extensions 64 and 64' from being moved accidentally to the Off position.

The buckle tang 22 slides within the opening 15 in the end 17 of the buckle 14. The push button 26 is spring biased outwardly by spring 31 to the locked position in a known manner and thus automatically latches the buckle parts together when it reaches opening 30 of the buckle 14. The edge 33 of the button 26 will bear against edge 32 in the opening 30 and hold tang 22 locked together with buckle 14.

A speaker 98 or other type of audible warning system is incorporated as indicated in FIGS. 5, 6, 9, and 11 and sounds when the alarm is activated.

An important advantage of the present invention is that the On/Off switch is mechanically moved to the On position every time the belt buckle 14 is latched and even if the belt buckle is unbuckled it will stay in the On position until manually moved to the Off position by depressing the handles 64 and 64' and moving them to the right, relative to firefighter 2 to the Off position.

Figure 11:
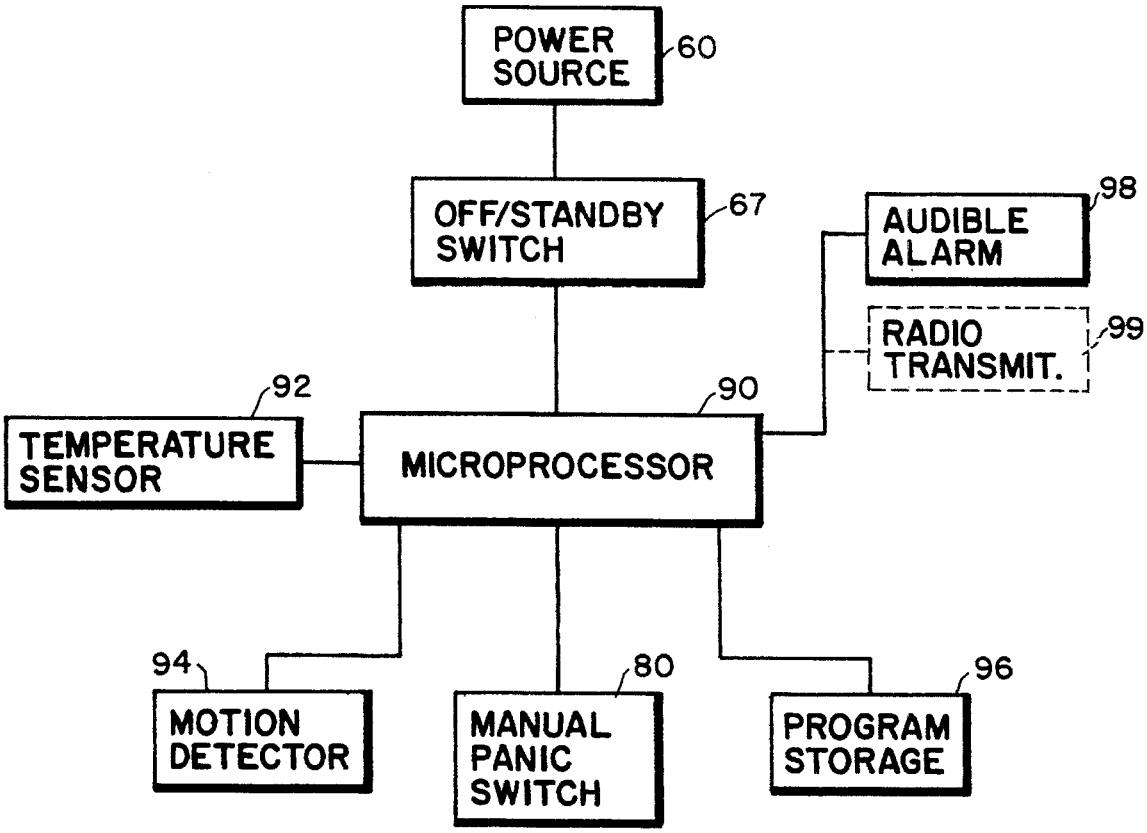
FIG. 11 is a schematic showing the operation scheme of a PASS warning system incorporated into the device of the present invention.

Referring to FIG. 11 the typical components of a PASS system are shown schematically. A battery power source 60, usually a 9 volt battery from which power is supplied to the system is controlled by the Off/On switch 67 operated by the handles 64 and 64' as is the Manual or panic switch 80 which is activated by further movement of the handle 64 and 64'. Power is supplied to the microprocessor 90. The temperature sensor 92 and motion detector 94 provide inputs to the microprocessor which is directed by the program 96. The audible alarm (speaker) is indicated at 98 and an optional radio transmitter is indicated at 99.

Operation of such systems is well known and it is not itself a part of the present invention.

Figure 4:
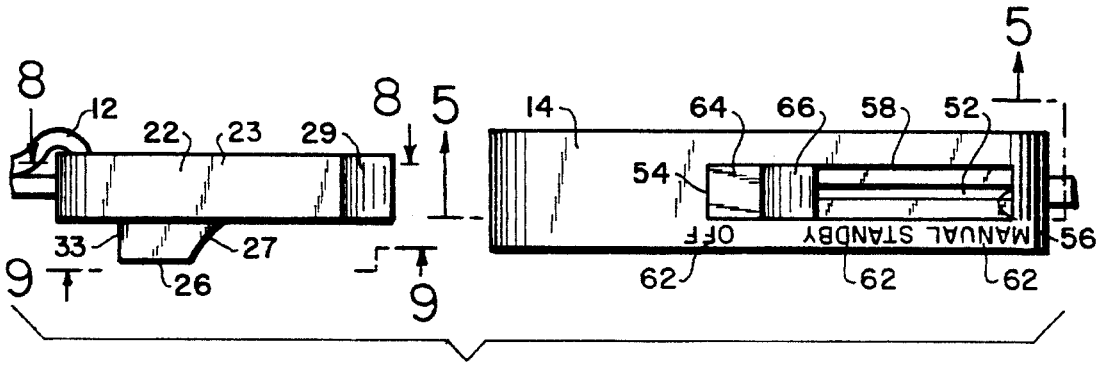
FIG. 4 is a top plan view of the device components as shown in FIG. 3.
Figure 6:
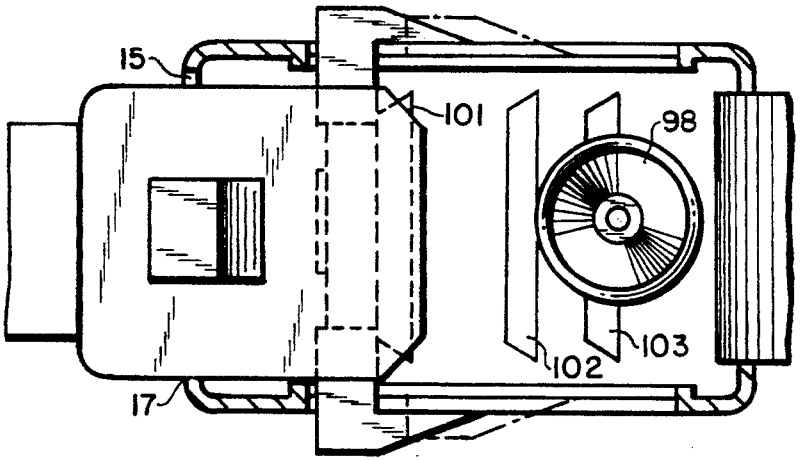
FIG. 6 is a front-plan view shown partially in section of the buckle before and after fastening.
Figure 7:
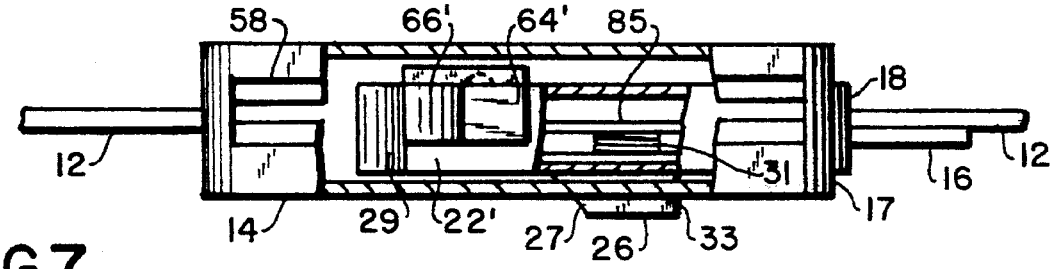
FIG. 7 is a bottom view of tang 22 and female portion 14 latched together with the bottom partially cut away.

As the tang 22 is slid into opening 15 and advances, it engages the switch stems 64 and 64' and advances the stem and switch from the Off position shown in FIGS. 2–4 to the On position of FIGS. 6 and 7 which sends power from the battery 60 to the Pass circuit components shown schematically in FIG. 11.

The switch(s) is prevented from going back to the Off position unintentionally by the nibs 82 and 84 as well as the end 29 of the tang 22 until the push button 26 is pressed to allow unbuckling and removal of the tang 22 and the ends 64 and 64' have been depressed and moved to the Off position. When the buckle is unbuckled the nibs 82 and 84 disengage from the recesses or slots 68 and 68'.

If necessary, the alarm can be manually activated by moving the switch arms 64 and 64' to the Manual position to contact the manual mode contact 103 which will set off the alarm immediately upon contact.

As shown in particularly FIGS. 7 and 8 in the tang portion 22 is a leaf spring 85 having arms 81 with nibs 82 and 84 at the ends thereof directed towards openings 83 and 87 in the rear wall 23 of tang 22.

The nibs 82 and 84 extend through the wall 23 and as the tang 22 is moved into part 14 they engage recesses or slots 68 and 68' in the switch arms 64 and 64' to drive the arms forward. The contacts 101 engage On/Off switch contact means 102. As the tang 22 is moved into part 14 the nibs 82 and 84 are extended through the openings 83 and 87 in the wall 23 of the tang 22 and engage the recesses or slots 68 and 68' to move the switch 101 forward to the left to the Standby or On as the buckle 14 is being latched. The arms 64 and 64' may be moved further left manually to the Manual or panic position. The arms 64 and 64' must be depressed to disengage the safety latch switch 101 in order for the arms 64 and 64' to be moved right from the Manual to the Standby position. In order to move switch arms 64 and 64' further to the Off position, the buckle 14 has to be unbuckled first. When the buckle 14 is being unlatched the nibs 82 and 84 slide out the ends of the slots 68 and 68', allowing the arms 64 and 64' to be moved to disengage the latch switch 101.

As indicated previously, appropriate PASS alarm circuits mechanisms can be incorporated, using state of art solid state devices to sense a lack of movement over a predetermined period, a certain temperature being reached, or the gradient of a temperature increase passing a predetermined value.

The basic concept of the present invention is to incorporate the system of PASS devices into the modified buckle system of the air pack harness of the firefighter in order to assure that the device is switched automatically to On when the firefighter dons the SCBA pack harness. This assures that the device will be on the On position anytime the firefighter enters a dangerous area which ordinarily requires utilization of an air mask.

It does not rely upon a separate action of the firefighter, under stressful conditions, to activate the PASS device by a separate action. By incorporating it in the belt it also assures that the PASS device does not fall off the firefighter's turnout gear by failure to secure it properly, but that it is automatically placed into use each time the harness for the air pack is donned and buckled and carried securely.

While the invention has been described by reference to an illustrative embodiment, it is not intended that the novel device be limited thereby, but that modifications thereof are intended to be included as falling within the broad spirit and scope of the foregoing disclosure, the following claims and the appended drawings.

What is claimed is:

1. Personal alarm safety apparatus for firefighters including temperature sensing means, motion sensing means, and means for sounding an audible alarm if there is no motion detected for a predetermined period of time or if the temperature reaches a predetermined temperature, said system including an Off, Standby, and a Manual switch means, said apparatus including an air bottle carrying harness having a waist strap with a two piece buckle system, said buckle system comprising a female buckle means and a male tang buckle means, said personal alarm safety system being contained within said female buckle portion means, whereby said personal alarm safety system is automatically switched to the Standby position when said tang portion of said buckle is inserted into said female portion of the buckle and automatically locked into the Standby position by button latching means carried in said tang portion of said buckle, means for manually activating said alarm, and safety latch means which must be operated in addition to unbuckling said buckle in order to turn off said personal alarm safety system.

* * * * *